US009290930B2

(12) United States Patent
Beals

(10) Patent No.: US 9,290,930 B2
(45) Date of Patent: Mar. 22, 2016

(54) INSULATION SYSTEM FOR A PRE-ENGINEERED METAL BUILDING

(71) Applicant: Therm-All, Inc., North Olmsted, OH (US)

(72) Inventor: William D. Beals, Winslow, ME (US)

(73) Assignee: Therm-all, Inc., North Olmsted, OH (US)

( * ) Notice: Subject to any disclaimer, the term of this patent is extended or adjusted under 35 U.S.C. 154(b) by 0 days.

(21) Appl. No.: 14/338,470

(22) Filed: Jul. 23, 2014

(65) Prior Publication Data

US 2015/0082725 A1 Mar. 26, 2015

Related U.S. Application Data

(60) Provisional application No. 61/880,575, filed on Sep. 20, 2013.

(51) Int. Cl.

| | |
|---|---|
| ***E04B 1/74*** | (2006.01) |
| ***E04B 1/66*** | (2006.01) |
| ***E04B 7/00*** | (2006.01) |
| ***E04D 3/35*** | (2006.01) |
| ***E04D 5/14*** | (2006.01) |
| ***E04D 13/00*** | (2006.01) |

(Continued)

(52) U.S. Cl.

CPC . *E04B 1/665* (2013.01); *E04B 1/24* (2013.01); *E04B 7/00* (2013.01); *E04D 3/351* (2013.01); *E04D 3/3603* (2013.01); *E04D 5/142* (2013.01); *E04D 5/144* (2013.01); *E04D 13/00* (2013.01); *E04D 13/1618* (2013.01); *E04D 13/1625* (2013.01); *E04H 5/10* (2013.01); *E04B 2001/2481* (2013.01); *E04B 2001/2487* (2013.01); *E04B 2001/2496* (2013.01)

(58) Field of Classification Search

CPC ..... E04B 1/665; E04B 7/00; E04D 13/00; E04D 3/351; E04D 5/142; E04D 5/144

USPC ..... 52/407.3, 404.1, 407.5, 406.1

See application file for complete search history.

(56) References Cited

U.S. PATENT DOCUMENTS

| | | |
|---|---|---|
| 3,307,306 A | 3/1967 | Oliver |
| 4,014,150 A | 3/1977 | Wells et al. |

(Continued)

FOREIGN PATENT DOCUMENTS

| | | |
|---|---|---|
| WO | 2011075541 | 8/2011 |

OTHER PUBLICATIONS

International Search Report and Written Opinion dated Nov. 19, 2014 for corresponding patent application No. PCT/US2014/047779.

(Continued)

*Primary Examiner* — Brian Glessner
*Assistant Examiner* — Paola Agudelo
(74) *Attorney, Agent, or Firm* — Wegman, Hessler & Vanderburg

(57) ABSTRACT

A pre-engineered metal building configured to reduce air leakage through the shell of the building by providing an insulation system for fully sealing an enclosed space within the structural frame of the building. The insulation system includes a vapor barrier that defines the enclosed space, at least one insulation layer, and a continuous air barrier. Roof sheeting and side wall facing are attachable to the structural frame to form a shell about the building, and at least a portion of the insulation system is positioned between the shell and the structural frame.

20 Claims, 11 Drawing Sheets

(51) Int. Cl.

| | |
|---|---|
| ***E04D 3/36*** | (2006.01) |
| ***E04D 13/16*** | (2006.01) |
| ***E04B 1/24*** | (2006.01) |
| ***E04H 5/10*** | (2006.01) |

(56) References Cited

U.S. PATENT DOCUMENTS

| | | | | |
|---|---|---|---|---|
| 4,446,664 | A * | 5/1984 | Harkins | 52/404.3 |
| 4,472,920 | A * | 9/1984 | Simpson | 52/741.4 |
| 4,573,298 | A * | 3/1986 | Harkins | 52/404.3 |
| 5,761,864 | A * | 6/1998 | Nonoshita | 52/302.3 |
| 5,826,388 | A * | 10/1998 | Irving | 52/302.1 |
| 5,953,883 | A * | 9/1999 | Ojala | 52/794.1 |
| 6,216,416 | B1 * | 4/2001 | West et al. | 52/749.12 |
| 6,279,284 | B1 * | 8/2001 | Moras | 52/408 |
| 7,490,444 | B2 * | 2/2009 | Nowack | 52/411 |
| 8,181,410 | B2 * | 5/2012 | Stensrud | 52/407.3 |
| 8,209,915 | B2 | 7/2012 | O'Leary et al. | |
| 8,371,083 | B2 * | 2/2013 | Chamberlin et al. | 52/506.04 |
| 8,438,810 | B2 * | 5/2013 | Robbins et al. | 52/407.3 |
| 8,844,230 | B2 * | 9/2014 | Harkins | 52/404.1 |
| 2005/0214496 | A1 * | 9/2005 | Borenstein | 428/40.1 |
| 2010/0146874 | A1 * | 6/2010 | Brown | 52/145 |
| 2011/0173913 | A1 * | 7/2011 | Bodsford et al. | 52/407.4 |
| 2011/0197530 | A1 * | 8/2011 | Bahnmiller | 52/309.4 |
| 2011/0296778 | A1 * | 12/2011 | Collins et al. | 52/220.1 |
| 2013/0067841 | A1 * | 3/2013 | Grieco et al. | 52/309.4 |
| 2014/0345223 | A1 * | 11/2014 | Miks et al. | 52/309.4 |

OTHER PUBLICATIONS

"Air Barriers: Increasing Building Performance, Decreasing Energy Costs"; DuPont Tyvek; Architectural Record; Jan. 2006.

"New Construction Insulation"; Steel Building Insulation; Mar. 15, 2012.

"SealedNSafe"; suspended system.mov; Youtube.com; Feb. 15, 2011.

Lstiburek, J.; "Understanding Vapor Barriers"; Building Science Digest 106; Oct. 24, 2006.

"Install HomeWrap Over Rigid Foam Board and Window"; DuPont Tyvek; DuPontWeatherization; Youtube.com; Apr. 9, 2013.

* cited by examiner

INSULATION SYSTEM FOR A PRE-ENGINEERED METAL BUILDING

CROSS-REFERENCE TO RELATED APPLICATIONS

The present application claims the benefit of U.S. Provisional Patent Application No. 61/880,575 filed on Sep. 20, 2013, which is hereby incorporated by reference in its entirety.

FIELD OF THE INVENTION

The present invention is directed to an insulation system within a pre-engineered metal building, and more particularly, to a continuous air barrier that is combined with at least one layer of insulation having a vapor barrier forming an envelope about the enclosed space of a pre-engineered metal building.

BACKGROUND OF THE INVENTION

Pre-engineered metal buildings have long been used for various types of structures, including, but not limited to, commercial building spaces such as warehouses, garages, auto-body shops, community centers, storage facilities, and more. Pre-engineered metal buildings typically require less labor and materials to produce, thereby reducing the costs with respect to typical residential or commercial buildings that utilize brick-and-mortar and/or wood framing. Often, entire sections of the pre-engineered metal building can be constructed off-site then shipped to the building site and installed or otherwise assembled with very few steps required.

One problem often associated with pre-engineered metal buildings is that metal sheeting on the outside walls and the roof of pre-engineered metal buildings allows water vapor to permeate therethrough and into the interior of the building or into the fiberglass layer on the inside of the metal sheeting. When water vapor is trapped in the fiberglass, or insulating layer, the thermal transfer through the insulation layer between the inside of the building and the outside of the building increases dramatically.

The principle function of a vapor barrier is to stop or retard the passage of moisture (water vapor) as it diffuses through materials. A vapor barrier or retarder is a material that offers more resistance to the diffusion of water vapor than most materials. The moisture diffusion control property of a material is called its "water vapor permeance" which provides a "perm rating," as it is commonly referred to in the industry. A material typically needs to have a perm rating of less than 1.0 to be considered a vapor retarder. Most of the facing materials, such as the metal sheeting, used with fiberglass insulation in the pre-engineered metal building industry, have a perm rating of about 0.02.

Typical pre-engineered metal buildings currently utilize a layer of insulation having a vapor barrier, wherein the vapor barrier is inward-facing and the insulation is positioned against the inner surface of the outer metal sheeting of the building between the metal sheeting and the vapor barrier. This vapor barrier is often punctured, pierced, or the overall integrity is otherwise compromised during construction with the installation of doors, windows, HVAC systems, electrical systems, sprinkler systems, and the like are attached to the building framework.

BRIEF SUMMARY OF THE INVENTION

A need therefore exists to reduce air movement through or into the insulation layer positioned between the external metal sheeting and the inward-facing vapor barrier, particularly during cold weather, through any punctures in the vapor barrier.

In one aspect of the present invention, a pre-engineered metal building is provided. The pre-engineered metal building includes a structural frame attached to a foundation. The building further includes an insulation system attached to the structural frame to define an enclosed space between the insulation system and the foundation. The insulation system includes a vapor barrier having an inwardly-facing surface and an outwardly-facing surface. The vapor barrier surrounds the enclosed space, and the inwardly-facing surface is directed toward the enclosed space. The insulation system further includes at least one insulation layer positioned adjacent to the vapor barrier and a continuous air barrier. The continuous air barrier is positioned outwardly relative to an innermost layer of said at least one insulation layer. The continuous air barrier provides a fully sealed enclosed space. The building also includes a plurality of panels of side wall facing attached to the structural frame, wherein at least a portion of the insulation system is positioned between the plurality of panels of side wall facing and the structural frame. Finally, the building includes a plurality of panels of roof sheeting attached to the structural frame, wherein at least a portion of the insulation system is positioned between the plurality of panels of roof sheeting and the structural frame.

Advantages of the present invention will become more apparent to those skilled in the art from the following description of the embodiments of the invention which have been shown and described by way of illustration. As will be realized, the invention is capable of other and different embodiments, and its details are capable of modification in various respects.

BRIEF DESCRIPTION OF SEVERAL VIEWS OF THE DRAWINGS

These and other features of the present invention, and their advantages, are illustrated specifically in embodiments of the invention now to be described, by way of example, with reference to the accompanying diagrammatic drawings, in which.

Figure 1:
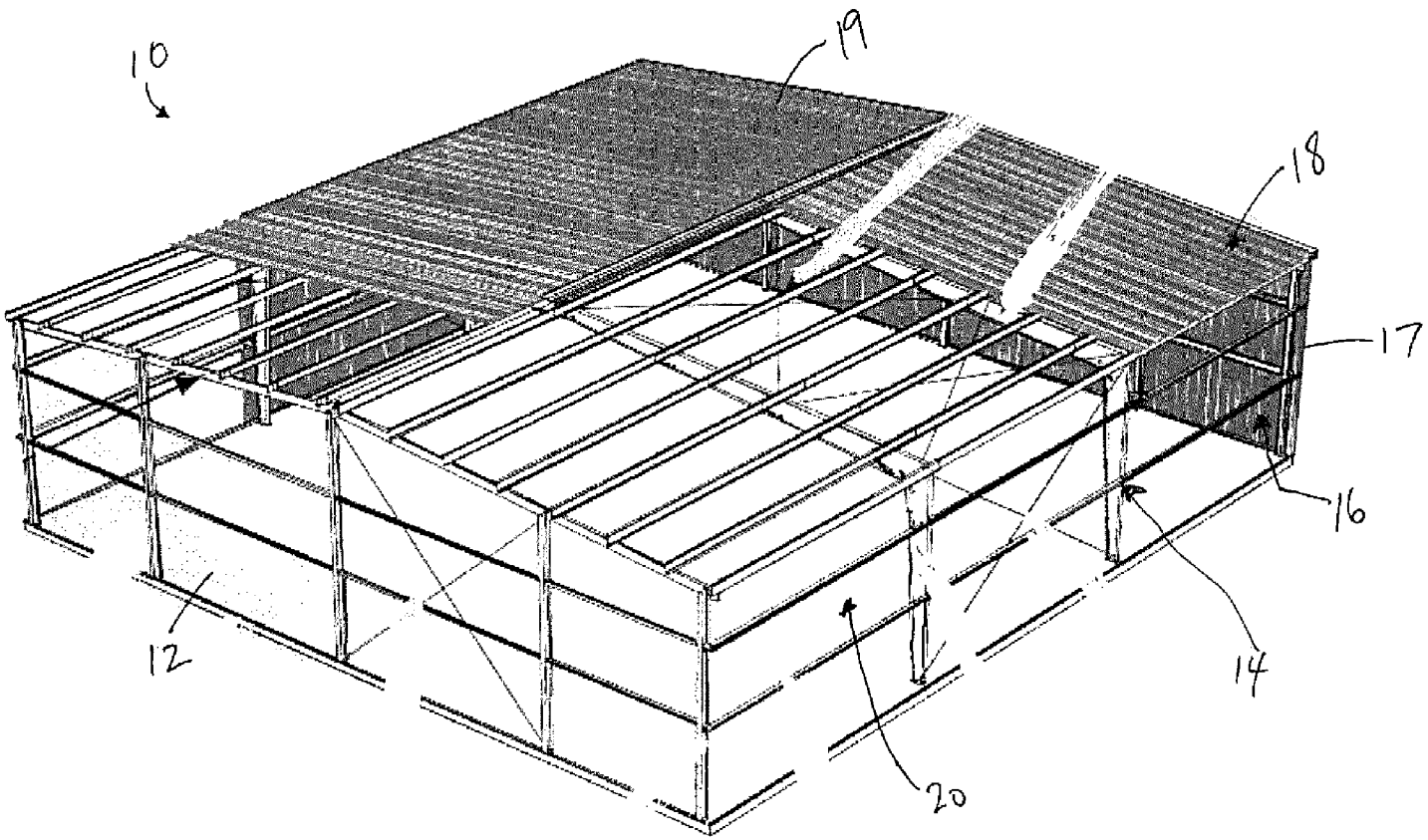
FIG. 1 is a perspective view of exemplary embodiment of a portion of a pre-engineered metal building.

It should be noted that all the drawings are diagrammatic and not drawn to scale. Relative dimensions and proportions of parts of these figures have been shown exaggerated or reduced in size for the sake of clarity and convenience in the drawings. The same reference numbers are generally used to refer to corresponding or similar features in the different embodiments. Accordingly, the drawing(s) and description are to be regarded as illustrative in nature and not as restrictive.

DETAILED DESCRIPTION OF THE PREFERRED EMBODIMENT

Pre-engineered metal buildings are a type of building in which the dimensions and structure are pre-designed such that each building from a particular manufacturer or builder is substantially the same so that the structural components can be pre-fabricated in larger quantities due to the components having the same size/shape for each building. Although the pre-engineered metal buildings may have different dimensions customized to each buyer, having one set (or a small set) of designs and layouts allows a manufacturer/builder to maximize the usage of materials with little or no scraps remaining. Pre-engineered metal buildings are different than typical residential and/or commercial buildings because the pre-engineered metal buildings include materials and construction techniques that are incompatible or otherwise less desirable with typical residential and commercial buildings.

Water vapor diffusion is only one of the mechanisms by which water vapor can be transported into a wall or roof cavity. The other mechanism is by way of air leakage though the building materials. One function of the air barrier is to stop ambient air from entering the building as well as to stop air within the enclosed space to exfiltrate through the building envelope to the ambient environment. Air leakage is caused by air pressure differences in at least one of three forms: (1) the stack effect, which is dependent upon the temperature difference between the air within the enclosed space and the ambient air surrounding the building; (2) a pressure difference may induce air flow through the building materials caused by wind forces acting on the building; and (3) the operation of ventilation equipment may produce a pressure differential between the enclosed space and the ambient environment surrounding the building.

Referring to FIG. 1, an exemplary embodiment of a pre-engineered metal building 10 attached to a foundation 12 is shown. The building 10 includes a structural frame 14, panels of side wall facing 16 attached to the structural frame 14 to form the side walls 17 and part of the outer shell, and panels of roof sheeting 18 attached to the structural frame 14 to form the roof 19 and more of the outer shell. The side walls 17 and roof 19 in conjunction with the foundation 12 define an enclosed space 20 therewithin. Pre-engineered metal buildings 10 are often used for businesses, garages, storage facilities, auto-body shops, community centers, and other commercial uses. Particularly when the interior air quality or occupant comfort is important, pre-engineered metal buildings 10 are constructed with an insulation system positioned along all side walls 17 and roof 19 to form an envelope about the enclosed space 20, wherein insulation system effectively wraps the structural frame 14 to reduce or slow the flow of water vapor into the enclosed space 20 through the side wall facing 16 and roof sheeting 18. The envelope separates the conditioned space with the ambient environment surrounding the building.

Figure 2:
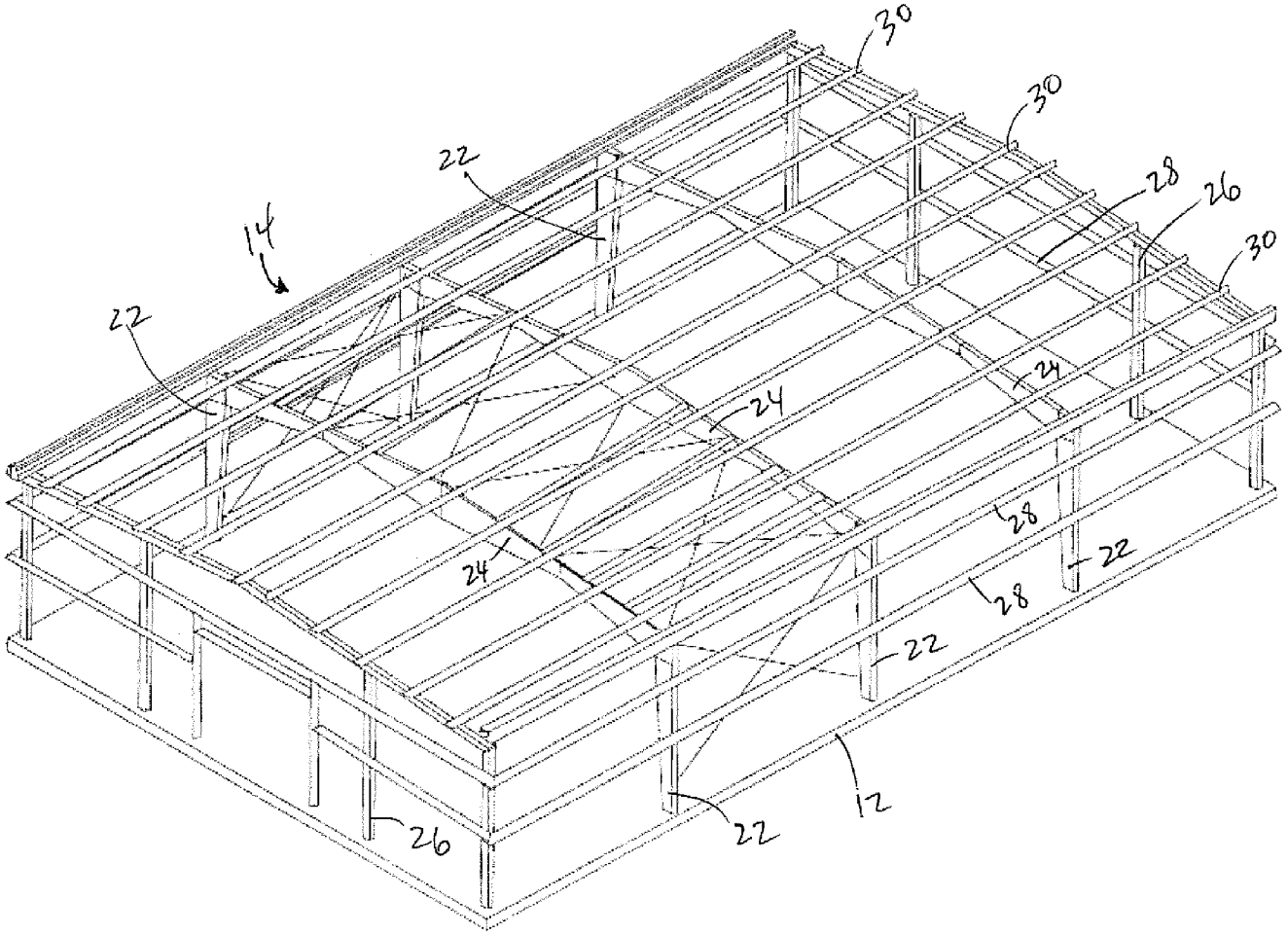
FIG. 2 is an embodiment of the structural frame of a pre-engineered metal building.

An exemplary embodiment of a structural frame 14 for a pre-engineered metal building 10 is shown in FIG. 2. The structural frame 14 includes a plurality of pairs of opposing, vertically oriented main frame columns 22, a main frame rafter 24 extending between each opposing pair of main frame columns 22, a plurality of vertically oriented secondary column 26, a plurality of substantially horizontally aligned girts 28 extending between columns 22, 26, and a plurality of purlins 30 extending between rafters 24. In the illustrated exemplary embodiment, the girts 28 are attached to the outwardly-directed surface of the columns 22, 26, and the purlins 30 are attached to the outwardly-directed surface of the rafters 24. In another embodiment, the girts 28 extend between the sides of the columns 22, 26, and the purlins 30 extend between the sides of the rafters 24. The structural frame 14 is fixedly attached to the foundation 12 to provide a solid base for the metal building 10 as well as aid in transferring loads from the structural frame 14 during various wind and environmental conditions. Each of the components of the structural frame 14 can be formed of the same material, or some components may be formed of on material and other components formed of other material(s). In an embodiment, the structural frame 14 is formed of steel. The columns 22, 26 and girts 28 form the structural support for the side walls 17, and the rafters 24 and purlins 30 form the structural support for the roof 19.

Figure 3A:
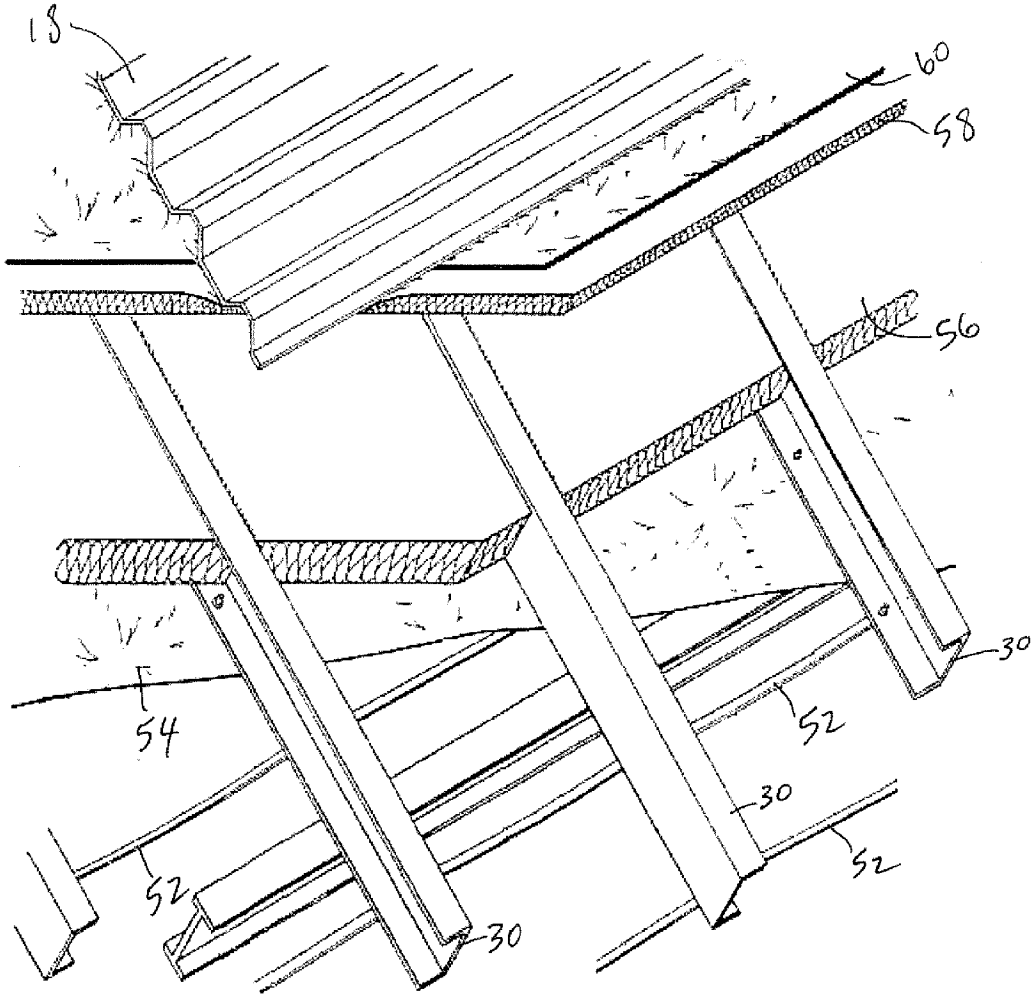
FIG. 3A is a sectional view of an embodiment of a portion of an insulation system.
Figure 3B:
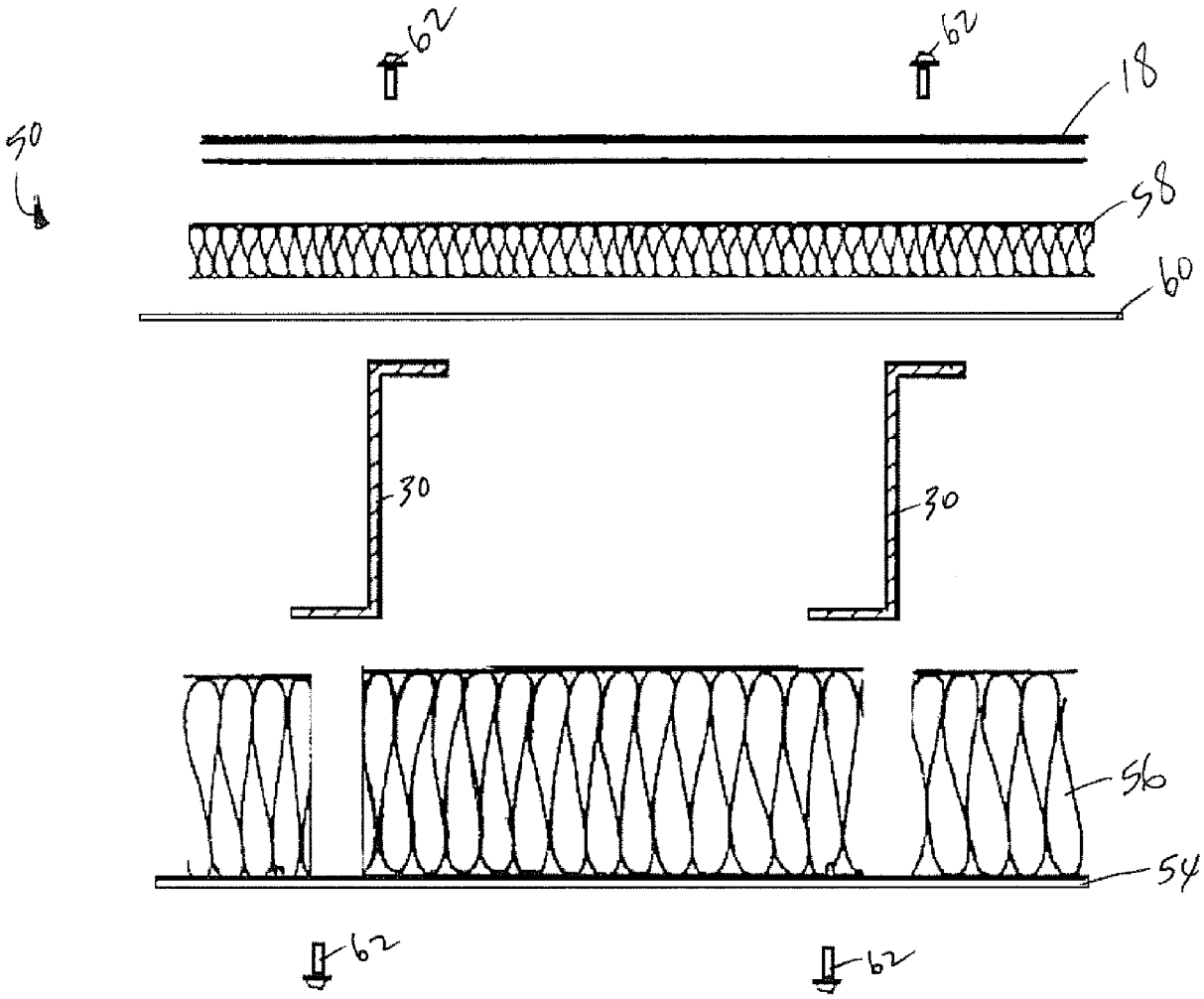
FIG. 3B is an exploded view of another embodiment of a portion of an insulation system.

The pre-engineered metal building 10 also includes an insulation system 50, portions of exemplary embodiments of which are shown in FIGS. 3A-3B, operatively connected to the structural frame 14 and which is sealingly connected to the foundation 12 to form a fully sealed envelope about the enclosed space 20. The insulation system 50 is incorporated with the structural components of the side walls 17 and the roof 19 to provide a combination of both a vapor barrier and an air barrier between the side wall facing 16, the roof sheeting 18, and the enclosed space 20. In an embodiment, the insulation system 50 includes a vapor barrier having an inwardly-directed surface directed inwardly toward the enclosed space, at least one insulation layer positioned adjacent to an outwardly-directed surface of the vapor barrier, and an air barrier positioned between the innermost of the insulation layers and the building shell (side wall facing 16 and roof sheeting 18). The insulation system 50 for a pre-engineered metal building 10 is configured to provide an envelope around the enclosed space 20 such that the envelope is fully sealed at the transitions between the roof 19 and the side walls 17 as wells as between the side walls 17 and the foundation 12. Although the insulation system 50 is configured to provide a completely or fully sealed enclosed space 20, it should be understood by one having ordinary skill in the art that the fully sealed enclosed space 20 may include at least one fenestration that is necessary to provide access to the enclosed space 20—such as doors and/or windows—or climate control features—such as HVAC systems or the like. While it is a goal to provide a fully sealed enclosed space 20 with the insulation system 50, slight air leakages as a result of installation or the result of degradation of materials over time are also encompassed within the meaning of a "fully sealed enclosed space."

FIG. 3A illustrates a portion of an embodiment of the insulation system 50 that is incorporated with the roof 19, wherein the insulation system 50 includes a plurality of bands 52 extending perpendicular to the purlins 30, a vapor barrier 54, a first insulation layer 56 oriented parallel to the purlins 30, a second insulation layer 58 oriented parallel to the rafters 24, and an air barrier 60. The outermost layer of the insulation system 50 is held in place by (or sandwiched between) the attachment of the roof sheeting 18 to the purlins 30 for the roof 19 and between the side wall facing 16 and the girts 28 of the side walls 17. FIG. 3B illustrates an exploded view of another embodiment of an insulation system 50 in which the vapor barrier 54 is fixedly attached to the first insulation layer 56, thereby eliminating the need for the bands 52. It should be understood by one skilled in the art that the vapor barrier 54 forms the innermost layer of the insulation system 50 that is directed toward the enclosed space 20, and the vapor barrier can be fixedly attached to a layer of insulation or may be installed separately from the next layer of insulation.

Figure 3C:
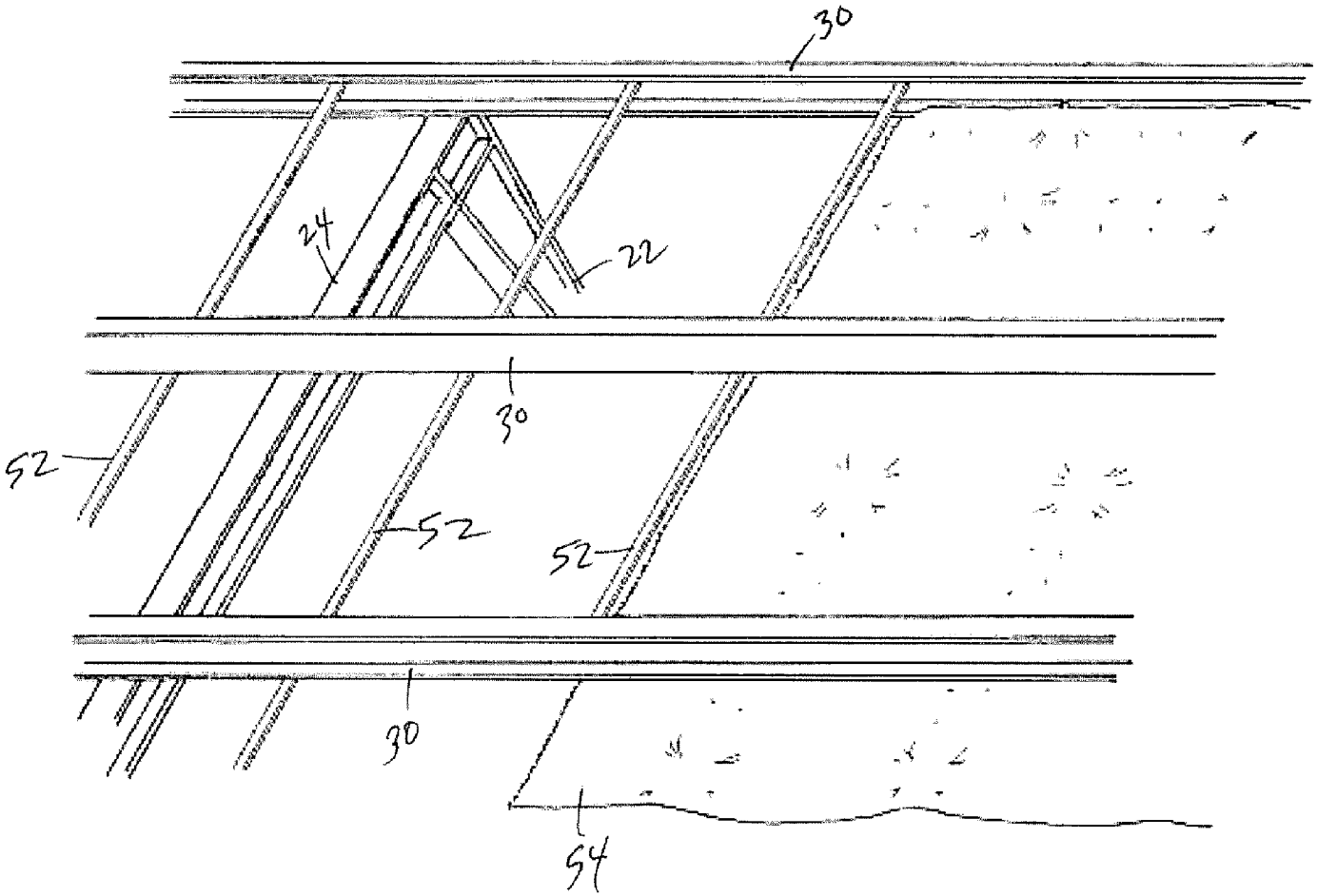
FIG. 3C is a perspective view of a portion of an insulation system.

The construction description provided herein will be in reference to the roof 19, but the same manner of construction of the insulation system 50 is used for the side walls 17. For example, reference to the purlins 30 of the roof 19 can be substituted with the girts 28 of the side walls 17, and reference to the roof sheeting 18 can be substituted for the side wall facing 16. When installing a portion of the insulation system 50 with the roof 19, the opposing ends of each band 52 is attached to the opposing eave struts at each end of the roof 19, wherein the bands 52 have some sag such that they are initially spaced-apart from the inwardly-directed surface of the purlins 30, as shown in FIG. 3C. The bands 52 are oriented substantially perpendicular relative to the purlins 30. A vapor barrier 54, formed as an elongated sheet, is then placed between the bands 52 and the purlins 30. The vapor barrier 54 can be formed as one continuous sheet that forms the entire inwardly-directed surface of the roof 19, or the vapor barrier 54 can be formed of multiple sheets in which adjacent sheets are integrally connected so as to form a continuous sheet to form the entire inwardly-directed surface of the roof 19. The vapor barrier 54 includes an inwardly-directed surface and an outwardly-directed surface, wherein the inwardly-directed surface is directed toward (and defines) the enclosed space 20 and the outwardly-directed surface is directed toward the ambient atmosphere surrounding the building. Once the vapor barrier 54 has been positioned between the bands 52 and the purlins 30, the bands 52 are then attached to each of the purlins 30 using mechanical fasteners 62 that provide a seal around the hole or puncture through the vapor barrier 54, such as a gasketed screw or the like. Once the bands 52 and vapor barrier 54 have been attached to the purlins 30, the inwardly-most surface of the insulation system 50 surrounding the enclose space 20 has been formed.

Once the vapor barrier 54 has been secured to the purlins 30 of the roof 19, a first insulation layer 56 is positioned parallel to the purlins 30 adjacent to the outwardly-directed surface of the vapor barrier 54, as shown in FIGS. 3A-3B. The first insulation layer 56 is configured to be positioned between adjacent purlins 30 in the roof 19, wherein the first insulation layer 56 ideally fills nearly the entire gap between adjacent purlins 30. In the embodiment shown in FIG. 3A, the first insulation layer 56 is an unfaced fiberglass layer; and in the embodiment shown in FIG. 3B, the first insulation layer 56 is an unfaced fiberglass layer in which the vapor barrier 54 is fixedly attached thereto. The vapor barrier 54 can be fixedly attached to the first insulation layer 56 by way of gluing, lamination, or any other method commonly known in the art. The first insulation layer 56 having the vapor barrier 54 fixedly attached thereto is often used in single-layer applications in which only one layer of insulation is used, but can also be used in multi-layer applications in which more than one layer of insulation is used.

In one embodiment, after positioning the first insulation layer 56 between adjacent purlins 30 in a parallel manner, an air barrier 60 is positioned between the first insulation layer 56 and the roof sheeting 18. Exemplary air barriers 60 may be Tyvek® CommercialWrap® (produced by DuPont Building Innovations), GreenGuard RainDrop Building Wrap (produced by Pactive Building Products), or other similar materials. It should be understood by one having ordinary skill in the art that the exemplary air barriers are formed as mechanically fastenable commercial building wraps, but the air barrier can also be formed of a self-adhered sheet material, a fluid applied membrane, sprayed polyurethane foam, boardstock, or the like. Vapor barriers 54 and vapor barrier materials are typically defined as having a vapor permeance of less than 0.02 L/(s-m$^2$) therethrough. While the vapor barrier 54 of the insulation system 50 is configured to reduce or eliminate moisture migration between the ambient environment and the enclosed space 20, the air barrier 60 of the insulation system 50 is configured to reduce or eliminate air leakage between the ambient environment and the layer(s) of insulation between the outer shell of the building (roof sheeting and side wall facing) and the enclosed space 20. The air barrier is configured to be formed in sheets that are attachable and sealable to each other to form a single layer that covers the entire roof 19 and another single layer that covers the side walls 17, wherein the roof layer and the side wall layer(s) are attachable to each other and the foundation 12 to fully seal and envelope the enclosed space 20. Because the air barrier 60 is being used for a pre-engineered metal building 10, the dimensions of the layer for the roof and the side walls is pre-designed so that each subsequent building has the same size and shape of air barrier 60 for the roof and side walls, thereby making it easier to one seamless layer instead of using multiple sheets that are attached to each other to form each portion. Although having one single sheet or layer for the roof and each of the side walls reduces the overall installation time, it should be understood by one having ordinary skill in the art that each of the different portions of the air barrier 60 (roof and each side wall) can also be formed using a plurality of sheets that are fixedly and sealingly attached to each other to form a larger sheet for each respective portion.

In one embodiment of the insulation system 50, as shown in FIG. 3B, a second insulation layer 58 is positioned adjacent to the air barrier 60 outwardly relative to the vapor barrier 54 such that the second insulation layer 58 is positioned between the air barrier 60 and the roof sheeting 18. In another embodiment of the insulation system 50, as shown in FIG. 3A, a second insulation layer 58 is positioned adjacent to the air barrier 60 inwardly relative to the vapor barrier 54 such that the air barrier 60 is positioned between the second insulation layer 58 and the roof sheeting 18. While these examples are provided as exemplary embodiments, it should be understood that the air barrier 60 can be located at any position between the vapor barrier 54 and the roof sheeting 18. For example, the air barrier 60 can be located immediately adjacent to the roof sheeting 18 such that the installation of electrical lines, HVAC ducts, or the like, within the walls 17 or the roof 19 may require cutting through the vapor barrier 54 without the need for cutting through the air barrier 60. Alternatively, the air barrier 60 can also be located immediately adjacent to the purlins 30 allows the air barrier 60 to be more easily attached purlins 30 to create and maintain a seal between the air barrier 60 with support from the structural frame 14. Maintaining the integrity of the air barrier 60 maximizes the efficiency of the insulation system 50 by substantially reducing or eliminating the air leakage therethrough which would otherwise reduce the efficiency of the insulation system 50.

Figure 3D:
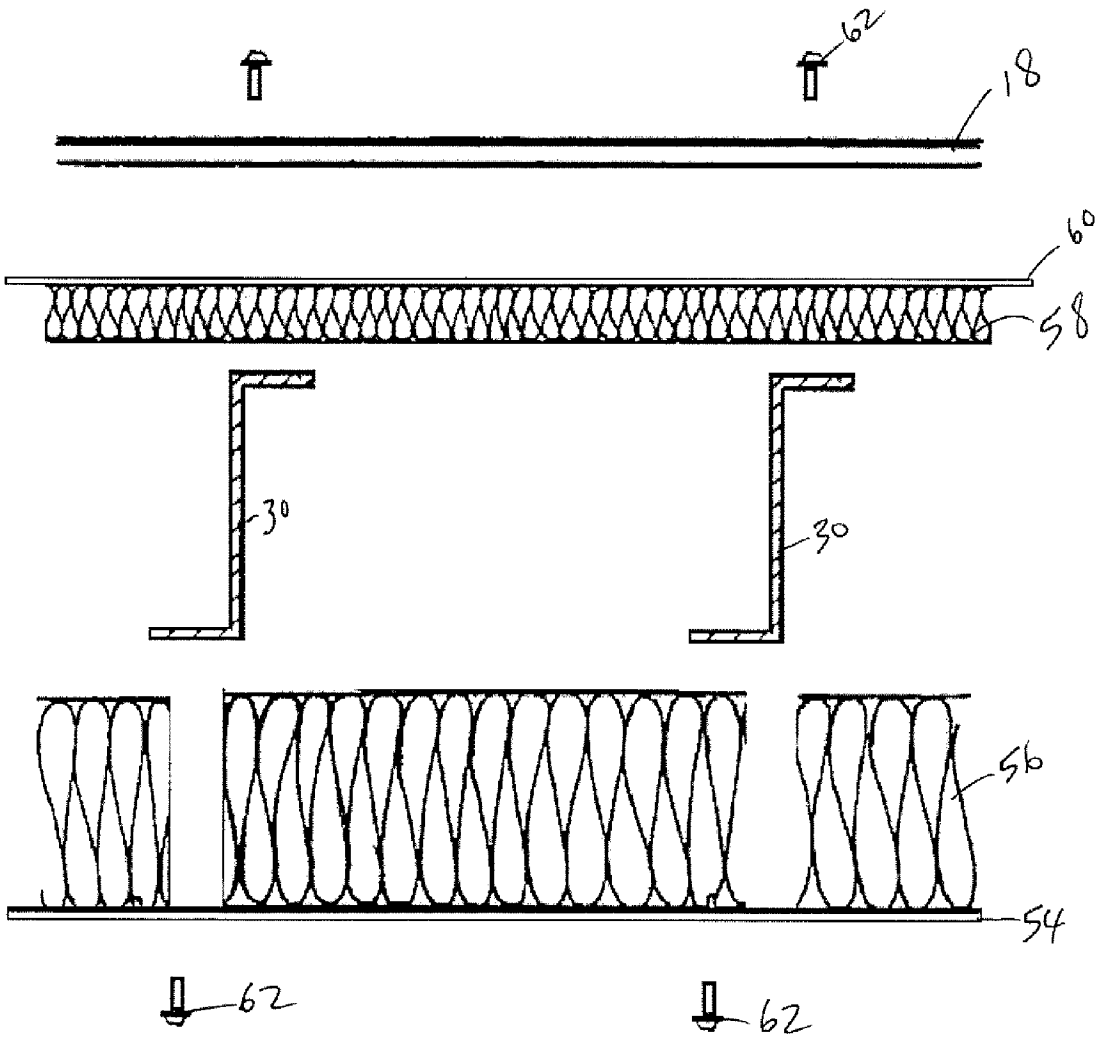
FIG. 3D is an exploded view of yet another embodiment of a portion of an insulation system.
Figure 3E:
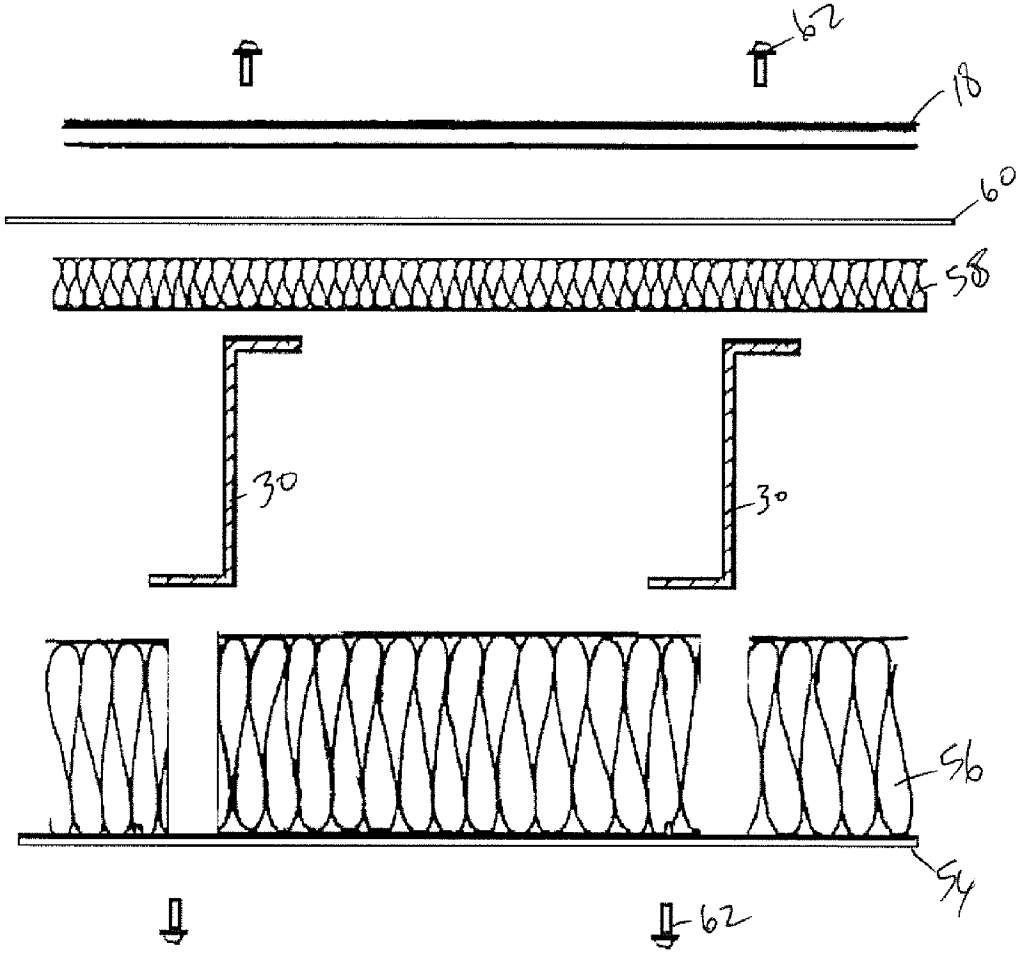
FIG. 3E is an exploded view of a further embodiment of a portion of an insulation system.
Figure 4A:
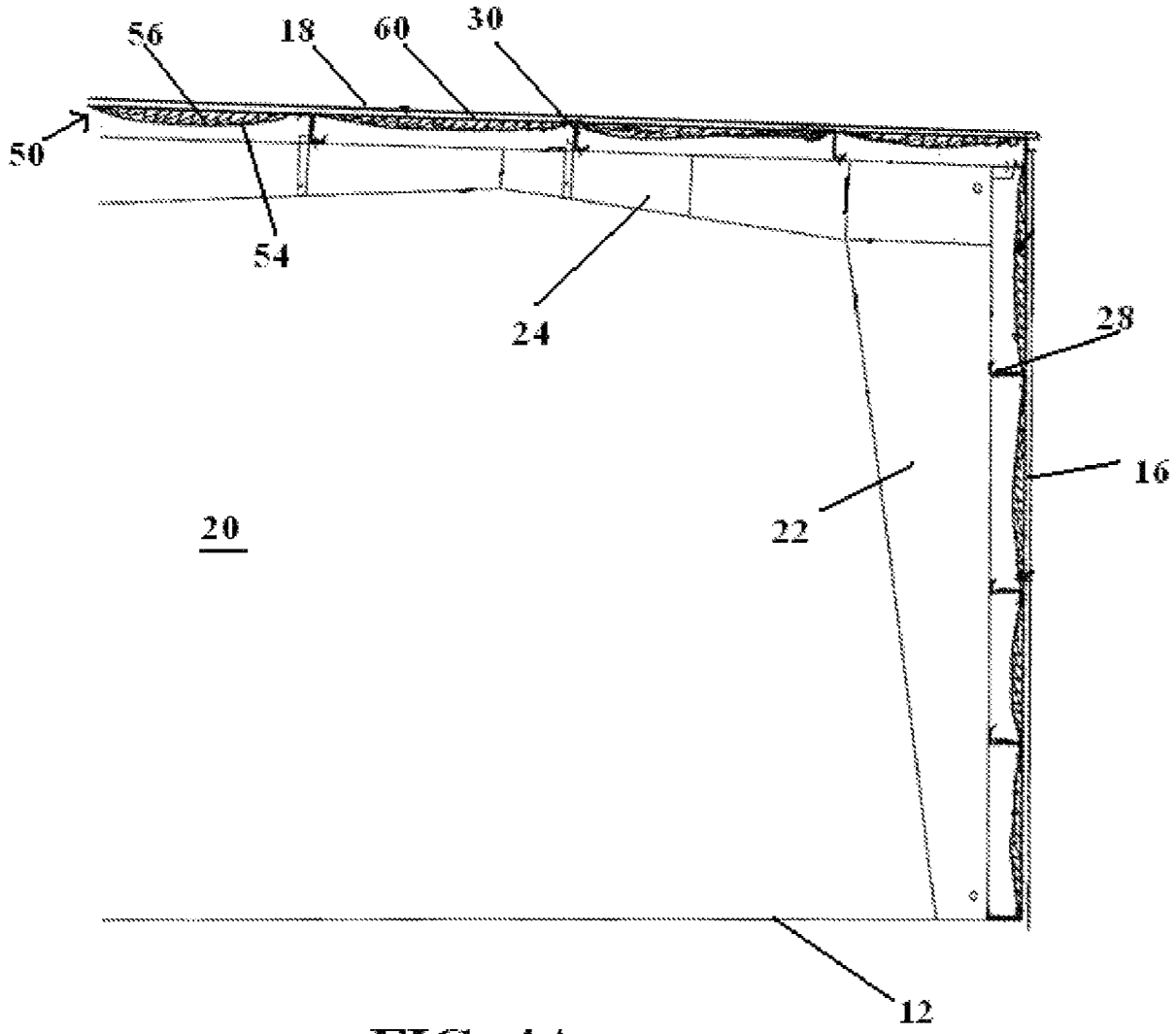
FIG. 4A is a sectional view of a portion of a pre-engineered metal building with an embodiment of an insulation system.
Figure 4B:
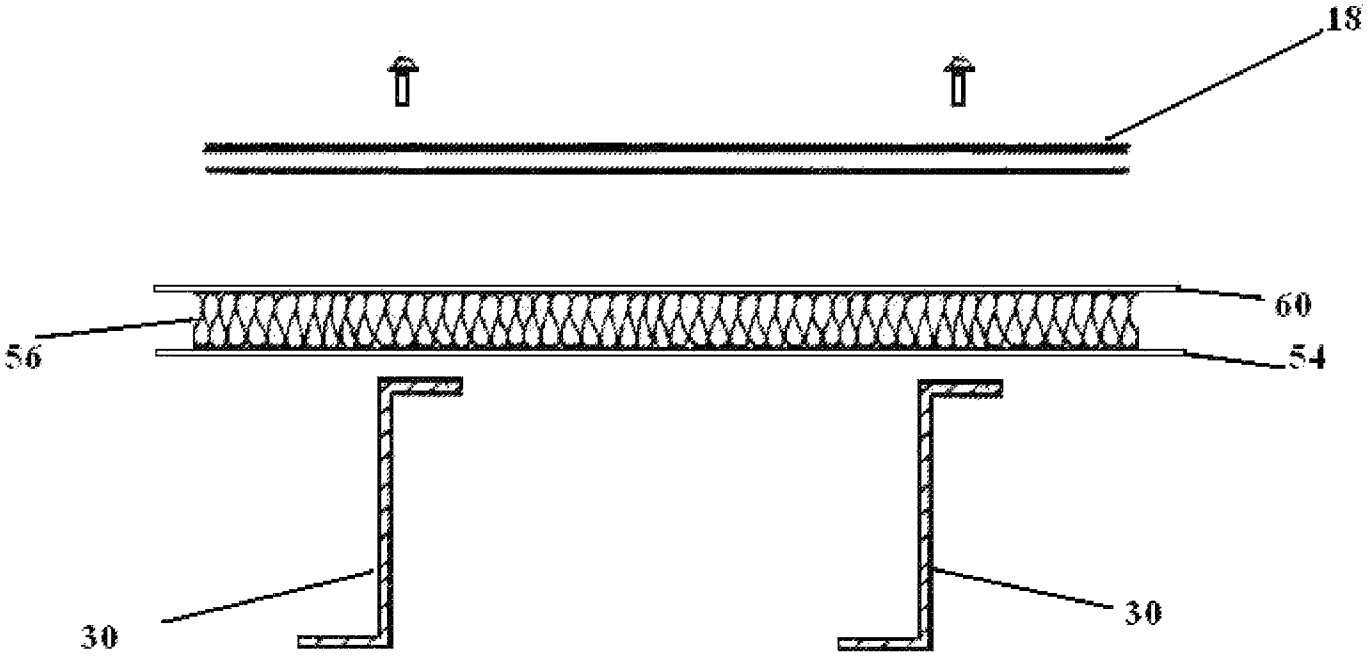
FIG. 4B is a cross-sectional view of the insulation system shown in FIG. 4A.

In an embodiment of the insulation system 50, as shown in FIGS. 3A and 3D, the air barrier 60 is fixedly attached to the second insulation layer 58. In another embodiment of the insulation system 50 shown in FIGS. 3B and 3E, the air barrier 60 is separate from the second insulation layer 58, but positioned immediately adjacent thereto in an abutting manner. The second insulation layer 58 is an unfaced layer of insulation, which can be formed of fiberglass, cotton, cellulose, or other similar material. In embodiments in which the air barrier 60 is fixedly attached to the second insulation layer 58, the air barrier 60 can be attached by gluing, laminating, or any other manner known in the art. The air barrier 60 attached to the second insulation layer 58 extends beyond at least one of the lateral (or long) edges of the second insulation layer 58 to form a flap, which is more easily sealingly attachable to the air barrier 60 attached to an adjacent second insulation layer 58. In a single-layer application, as shown in FIG. 4, in which only the first insulating layer 56 is used for the insulation system 50, the air barrier 60 is fixedly attached to the outwardly-directed surface of the first insulation layer 56 and the vapor barrier 54 is fixedly attached to the inwardly-directed surface of the first insulation layer 56. In another embodiment of a single-layer application, the air barrier 60 is positioned adjacent to the outwardly-directed surface of the first insulation layer 56 in an abutting relationship therewith and the vapor barrier 54 is fixedly attached to the inwardly-directed surface of the first insulation layer 56.

In one embodiment, the second insulation layer 58 is installed adjacent to the air barrier 60 when the air barrier 60 is positioned immediately adjacent to the purlins 30 (FIG. 3B). In another embodiment the second insulation layer 58 is installed adjacent to the purlins 30, after which the air barrier 60 is positioned adjacent to the outwardly directed surface of the second insulation layer 58 (FIG. 3A). Once the second insulation layer 58 and air barrier 60 are installed or otherwise positioned relative to the structural frame 14, the roof 19 portion of the insulation system 50 is integrated with the side wall portion(s) at the eave struts to form a continuous air barrier 60 about the entire enclosed space 20. The insulation system 50 is also integrated with the foundation 12 to ensure a proper seal between the insulation system and the foundation 12 in order to form a fully sealed enclosed space 20.

Once the insulation system 50 has been installed, the roof sheeting 18 and side wall facing 16 are positioned immediately adjacent to the outwardly-directed surface of the outermost layer of the insulation system 50. The roof sheeting 18 and side wall facing 16 are secured to the purlins 30 and girts, respectively, by attachment mechanisms 62, such as bolts or the like, wherein the attachment mechanisms 62 extend through both the second insulation layer 58 and the air barrier 60. The attachment mechanisms 62 are configured to maintain the integrity of the air barrier 60 by sealing the intrusion therethrough.

Figure 3F:
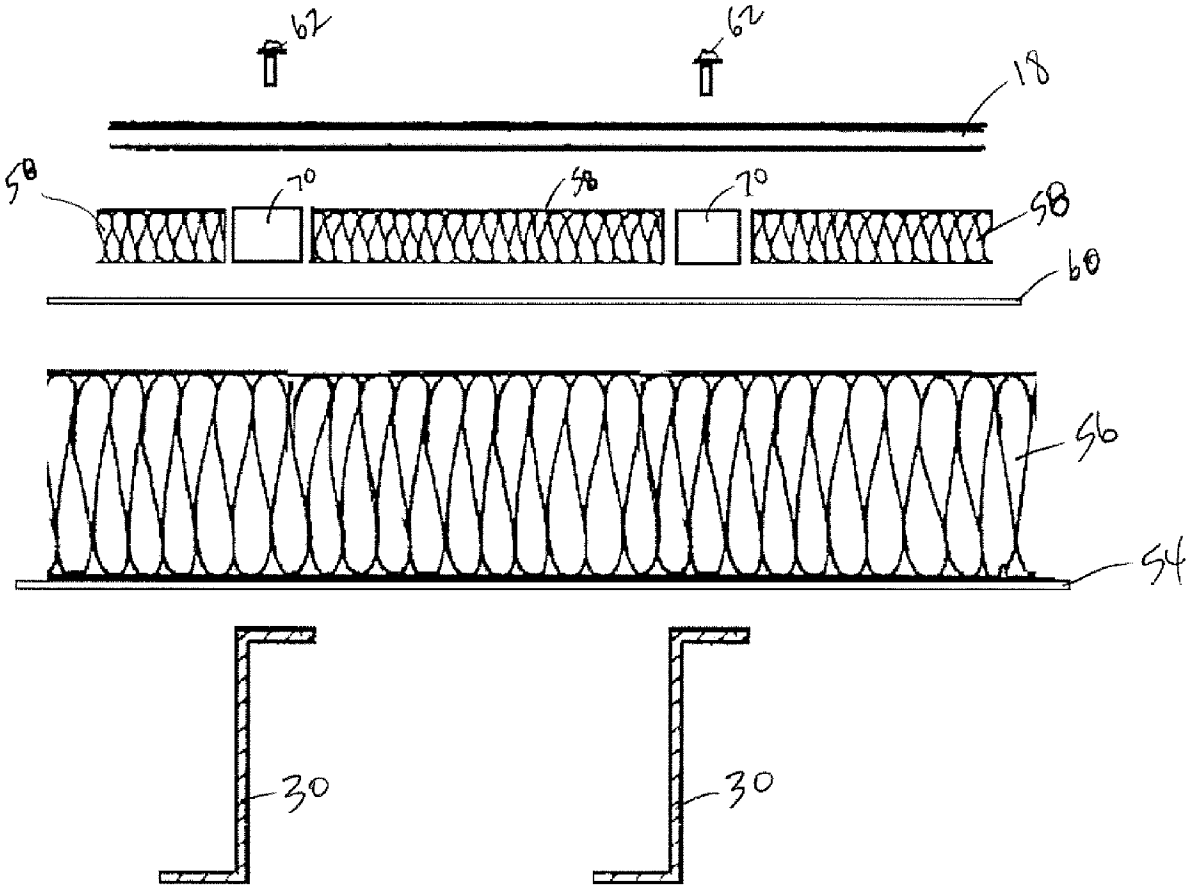
FIG. 3F is an exploded view of another embodiment of a portion of an insulation system.

In another exemplary embodiment of the insulation system 50, as shown in FIG. 3F, the vapor barrier 54 is fixedly attached to the first insulation layer 56, and the combined first insulation layer 56/vapor barrier 54 is positioned adjacent to the outwardly-directed surface of the purlins 30 in a perpendicular manner. A separate air barrier 60 is positioned adjacent to the unfaced surface of the first insulation layer 56 such that the air barrier 60 is positioned outwardly from the first insulation layer 56 relative to the purlins 30. The second insulation layer 58 is formed of rolls of unfaced insulation that are oriented parallel to the purlins 30 and positioned outwardly relative to the air barrier 60. Spacers 70 are positioned between adjacent rolls of the unfaced insulation of the second insulation layer 58 to minimize the gaps between adjacent rolls of unfaced insulation to prevent a loss of R-value of the insulation system 50. When the roof sheeting 18 is attached, the vapor barrier 54, first insulation layer 56, air barrier 60, and spacers 70 are sandwiched between the roof sheeting 18 and the purlins 30, and the second insulation layer 58 is sandwiched between the roof sheeting 18 and the air barrier 60. It should be understood by one having ordinary skill in the art that alternative embodiments of the insulation system 50 shown in FIG. 3F may have the air barrier 60 positioned between the second insulation layer 58/spacers 70 and the roof sheeting 18 or the air barrier 60 may be fixedly attached to the second insulation layer 58. This installation method is typically referred to as "sag and bag."

Figure 3G:
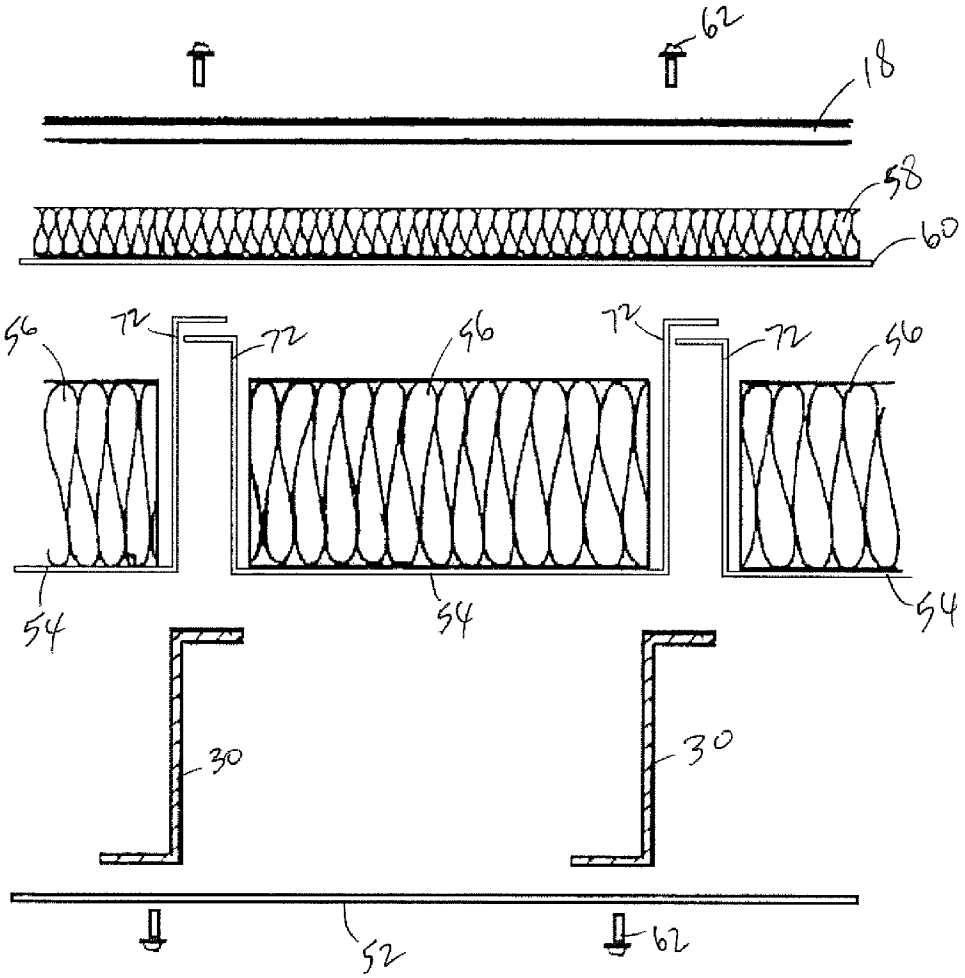
FIG. 3G is an exploded view of a further embodiment of a portion of an insulation system.

In yet another exemplary illustrated embodiment of the insulation system 50, as shown in FIG. 3G, the bands 52 described above are position adjacent to the inwardly-directed surface of the purlins 30. The vapor barrier 54 is fixedly attached to the first insulation layer 56, wherein the vapor barrier 54 extends beyond the lateral edges of the roll of insulation to which it is attached so as to form tabs 72. The tabs 72 extend from at least one lateral edge of the first insulation layer 56. The embodiment illustrated in FIG. 3G shows the vapor barrier 54 fixedly attached to the first insulation layer 56 and extending therefrom to form tabs 72 that extend from both lateral edges of the first insulation layer 56. The first insulation layer 56 having the vapor barrier 54 attached thereto and forming tabs 72 extending therefrom is positioned adjacent to the bands 52 and oriented parallel to the purlins 30 such that the tabs 72 extend over the outwardly directed surface of the purlins 30. Tabs 72 extending from adjacent rolls of the first insulation layer 56 are overlapped against the purlin 30. Each tab 72 extends laterally from the first insulation layer 56 between about four inches (4.0") to about eighteen inches (18.0"), but it should be understood by one having ordinary skill in the art that the length of the tabs 72 should be sufficient to ensure that the tabs 72 are able to extend parallel to the side edges of the first insulation layer 56 and still be able to cover a portion of the outwardly directed surface of the purlin 30 with enough length to overlap the tab 72 of the adjacent first insulation layer 56. The second insulation layer 58 having the air barrier 60 fixedly attached to the inwardly-directed surface thereof is positioned adjacent to the first insulation layer 56 in a perpendicular orientation such that the air barrier 60 contacts the unfaced surface of the first insulation layer 56 as well as directly contacts the overlapping tabs 72 of the vapor barrier 54. It should be understood by one having ordinary skill in the art that the insulation system 50 illustrated in FIG. 3G may include the air barrier 60 fixedly attached to the outwardly-directed surface of the second insulation layer 58 or positioned adjacent to either the inwardly-directed or outwardly-directed surface of the second insulation layer 58 in an abutting (non-fixedly attached) manner. The roof sheeting 18 is then positioned adjacent to the second insulation layer 58.

The fully sealed envelope about the enclosed space 20 of a pre-engineered metal building 20 has inherent weaknesses at the joints between the roof 19 and side walls 17 and between the side walls 17 and the foundation 12. It should be understood by one having ordinary skill in the art that the manner in which the air barrier 60 of the side walls 17 is attached and integrated with the air barrier 60 of the roof 19 and between the side walls 17 and the foundation 12 can be done in any manner that provides a continuous air barrier 60 which is formed to fully surround the enclosed space 20. The insulation systems 50 described above are configured to provide a continuous air barrier 60 about the enclosed space 20 in order to reduce or eliminate air leakage. The continuous air barrier 60 surrounding the enclosed space 20 of a pre-engineered metal building 10 provides a comfortable interior working/storage space, increased thermal efficiency, and energy savings. The continuous air barrier 60 also eliminates or reduces occupant discomfort as a result of drafts, degradation of the building materials due to moisture, poor indoor air quality due to ingress of fumes, dust, and the like, difficulties in balancing the HVAC system, noise travel through leakage paths, and microbial growth within building cavities.

While preferred embodiments of the present invention have been described, it should be understood that the present invention is not so limited and modifications may be made without departing from the present invention. The scope of the present invention is defined by the appended claims, and all devices, processes, and methods that come within the meaning of the claims, either literally or by equivalence, are intended to be embraced therein.

What is claimed is:

1. A pre-engineered metal building comprising:

a structural frame attached to a foundation, an insulation system attached to said structural frame to define an enclosed space between said insulation system and said foundation, said insulation system comprising:

a vapor barrier having an inwardly-facing surface and an outwardly-facing surface, said vapor barrier surrounding said enclosed space, and said inwardly-facing surface directed toward said enclosed space;

at least one insulation layer positioned adjacent to said vapor barrier; and a continuous air barrier positioned outwardly relative to an innermost layer of said at least one insulation layer, said continuous air barrier being sealingly attached to said foundation to fully seal said enclosed space;

a plurality of panels of side wall facing attached to said structural frame, wherein at least a portion of said insulation system is positioned between said plurality of panels of side wall facing and said structural frame; and a plurality of panels of roof sheeting attached to said structural frame, wherein at least a portion of said insulation system is positioned between said plurality of panels of roof sheeting and said structural frame.

2. The pre-engineered metal building of claim 1, wherein said at least one insulation layer includes a first insulation layer and a second insulation layer.

3. The pre-engineered metal building of claim 2, wherein said first and second insulation layers are each formed of a plurality of rolls of insulation aligned substantially parallel to each other to form said layer, and said rolls of insulation forming said first and second insulation layers are oriented perpendicular to each other.

4. The pre-engineered metal building of claim 2, wherein said air barrier is positioned between said first and second insulation layers.

5. The pre-engineered metal building of claim 2, wherein said air barrier is positioned between said second insulation layer and either said panels of side wall facing or said panels of roof sheeting.

6. The pre-engineered metal building of claim 1, wherein said at least one insulation layer includes only a first insulation layer.

7. The pre-engineered metal building of claim 6, wherein said air barrier is fixedly attached to said first insulation layer.

8. The pre-engineered metal building of claim 6, wherein said air barrier is separate from said first insulation layer and positioned adjacent to said first insulation layer in an abutting manner.

9. A pre-engineered metal building comprising:

a structural frame attached to a foundation, an insulation system attached to said structural frame to surround an enclosed space between said insulation system and said foundation, said insulation system comprising:

a layer of insulation having an inner surface and an outer surface;

a vapor barrier positioned immediately adjacent to said inner surface of said layer of insulation, said vapor barrier defining said enclosed space; and a continuous air barrier positioned adjacent to said outer surface of said layer of insulation, said continuous air barrier being sealingly attached to said foundation to fully seal said enclosed space;

a plurality of panels of side wall facing attached to said structural frame; and a plurality of panels of roof sheeting attached to said structural frame.

10. The pre-engineered metal building of claim 9, wherein said vapor barrier is fixedly attached to said inner surface of said layer of insulation.

11. The pre-engineered metal building of claim 9, wherein said continuous air barrier is fixedly attached to said outer surface of said layer of insulation.

12. The pre-engineered metal building of claim 9, wherein said insulation system further includes a second layer of insulation positioned adjacent to an outer surface of said continuous air barrier.

13. The pre-engineered metal building of claim 9, wherein said insulation system further includes a second layer of insulation positioned adjacent to an inner surface of said continuous air barrier.

14. The pre-engineered metal building of claim 9, wherein said continuous air barrier is positioned immediately adjacent to said outer surface of said layer of insulation.

15. The pre-engineered metal building of claim 9, wherein at least a portion of said insulation system is disposed between said plurality of panels of side wall facing and said structural frame and between said plurality of panels of roof sheeting and said structural frame in a sandwiching manner.

16. The pre-engineered metal building of claim 9, wherein said continuous air barrier is formed of a plurality of sheets being sealingly attached to each other.

17. A pre-engineered metal building comprising:

a structural frame attached to a foundation, an insulation system attached to said structural frame and surrounding an enclosed space between said insulation system and said foundation, said insulation system comprising:

at least one layer of insulation, wherein said at least one layer of insulation includes an innermost layer, said innermost layer having an inner surface and an outer surface;

a vapor barrier attached to said inner surface of said innermost layer of insulation, said vapor barrier defining said enclosed space; and a continuous air barrier positioned outwardly relative to at least one of said at least one layer of insulation, said continuous air barrier being sealingly attached to said foundation to fully seal said enclosed space;

a plurality of panels of side wall facing and a plurality of panels of roof sheeting attached to said structural frame.

18. The pre-engineered metal building of claim 17, wherein said continuous air barrier is formed of a plurality of sheets being sealingly attached to each other.

19. The pre-engineered metal building of claim 17, wherein said continuous air barrier is fixedly attached to one of said at least one layer of insulation.

20. The pre-engineered metal building of claim 17, wherein said continuous air barrier is positioned between said structural frame and said plurality of panels of side wall facing and said roof sheeting.

* * * * *